US006050053A

United States Patent [19]

Schmidt

[11] Patent Number: 6,050,053

[45] Date of Patent: Apr. 18, 2000

[54] CLUTCH CONTROL FOR A CLUTCH-ACTUATED BAG CLOSING HEAD

[76] Inventor: Norman G Schmidt, 2187 Rietta Crt., Burnaby BC, Canada, V3J 7J7

[21] Appl. No.: 09/009,781

[22] Filed: Jan. 20, 1998

[51] Int. Cl.[7] ..... B65B 51/04

[52] U.S. Cl. ..... 53/138.3; 53/64; 192/17 R

[58] Field of Search ..... 192/17 R; 53/64, 53/138.3

[56] References Cited

U.S. PATENT DOCUMENTS

| | | | |
|---|---|---|---|
| 3,163,969 | 1/1965 | Irwin et al. | 53/64 |
| 3,163,972 | 1/1965 | Irwin | 53/64 |
| 4,077,187 | 3/1978 | Paxton | 53/64 |
| 5,269,120 | 12/1993 | Holmes | 53/64 |

*Primary Examiner*—Stephen F. Gerrity
*Assistant Examiner*—Eric J. Weierstall

[57] ABSTRACT

An improvement to prior art bag closure affixing devices of the type embodied in U.S. Pat. No. 3,163,967 to easily accommodate bags of various neck widths without the need for gear or sprocket changes. The improvement encompasses a modified clutch control for the bag closing head. The clutch is controlled by a clutch actuating arm which is mechanically connected to the clutch. When the actuating arm is depressed, the clutch disengages from a first stop surface and rotates only partially until engaging a second stop surface. The second stop surface remains in contact with the clutch, preventing completion of the closing cycle, until the bag neck completely passes over the actuating arm and the actuating arm is released. The second stop surface then disengages the clutch allowing the bag closing head to complete a closing cycle with bags of varying neck sizes without frictional damage to the bag or incomplete entry of the full bag neck.

2 Claims, 2 Drawing Sheets

CLUTCH CONTROL FOR A CLUTCH-ACTUATED BAG CLOSING HEAD

TECHNICAL FIELD

There presently exists machines, such as that shown in U.S. Pat. Nos. 3,163,967 and 3,163,972 to Irwin, which close the open end of bags which have been typically filled with food products such as bread, rolls and potatoes. In the operation of the prior art machines, bags are closed by gathering and enclosing the neck of the bag within the aperture of a semi rigid plastic closure, known in the industry as a KWIK LOK. Particularly, the bag material is fed with separately controlled feed rollers to a bag closing head. In the prior art machines, the material is fed into a semi-rigid bag closure over a deflecting arm which activates the bag closing head producing a single cycle of operation and attaches a semi-rigid bag closure. A problem with the prior art machines of this design is the need for gear changes to accommodate different bag sizes, as stated in U.S. Pat. No. 5,269,120 to Holmes.

OBJECTS OF THE INVENTION

A first object of the present invention is an improvement of the prior art machines to allow them to close bags of varying neck sizes without the requirement for manual adjustment, namely gear changes.

A further object is to permit the machines to accommodate varying sizes of smaller bag neck widths without the frictional damage associated with the known prior art machines by providing improved mechanical control of the bag closing head.

A further object is to permith the machines to accommodate varying sizes of larger bag neck widths by preventing the closing cycle from ending prematurely and leaving excess bag material outside of the closure.

DESCRIPTION OF RELATED ART

Many products are packaged in flexible film bags. These bags can be closed with various types of mechanical closures of the type described in U.S. Pat. Nos. 4,911,293, 3,164,250 and 3,164,249. These prior art machines are typically located adjacent to a conveyor which carries bagged goods to the closure affixing machine. The closure affixing machine automatically gathers the bag material into and releases the bag neck closure once the bag neck is fully confined within the aperture of the closure. The operation and design of such machines is fully described in U.S. Pat. No. 3,169,972, herein incorporated by reference (hereinafter '967). Prior art machines of the type described in '967, feed the bag over a deflecting plate. The bag is fed with separately controlled feed rollers over the bag deflecting plate, depressing the plate, and feeding the bag into the closing head of the closure affixing machine. The closing cycle is initiated by the depression of the deflecting plate which is connected to a swinging arm which is in turn connected to an adjustable connecting rod and then to a rotary clutch operating dog. Once the deflecting plate is depressed, the operating dog is rotated, releasing the rotary clutch, producing a single progression of the bag closing cycle resulting in the attachment of a semi-rigid bag closure.

A long felt problem with prior art machines of this design is the need to change gear settings to accommodate different bag sizes. A further limitation of the prior art machines is upon entry of the flexible plastic bag into the machine, the closing cycle would be initiated and maintained until the cycle was complete. The machines are thus only capable of sensing the entry of the bag as it enters the bag closing head and not capable of sensing the bag neck's trailing edge. With the closing operation's period governed by a relationship between chain driven components of the unit the cycle time is fixed. If a gear change was not made in prior art machines of this type, in the case of larger sized bags, the closing cycle would end prematurely resulting in excess bag material outside of the closure. In the case of smaller sized bags, the closing cycle would continue to hold the bag as if for a larger sized bag and the bag would remain in the closing head in contact with the feed roller, resulting in frictional damage to the bag. Thus, in most cases, these closure affixing machines are adjusted to a particular size of bag and the closing unit is dedicated to closing that size bag. Problems arise in instances where bags of various sizes have to be closed by a single machine or where a spare closing unit is desired. This precise problem is explained and solved in U.S. Pat. No. 5,269,120, however this patent is directed to a design departure from the prior art devices upon which this improvement is based and utilizes complex computer controls.

The improvement which is the focus of the invention is directed to an improved clutch control for the clutch-activated bag closing head which would allow prior art machines to operate in a manner such that they will be self-adjusting to the width of the bag being fed into the closing unit. The range of size will be determined by the minimum width which the device is set for and will accommodate all widths beyond that length provided that gathered bag material will physically fit within the confines of the bag closure.

SUMMARY OF THE INVENTION

This invention is an improvement to prior art models of the bag closure affixing devices. When the invention is installed in these prior art machines, they are able to close a large range of bag widths without making clutch position adjustments or sprocket changes. The invention is able to sense, through the depression of an actuating arm, the leading edge of the flexible plastic bag neck as it enters or just prior to it entering into the closure and thereby initiates the closing cycle, as is known in the prior art. The closing operation is then interrupted to allow the flexible plastic bag to enter the closure until the bag is fully in the closure and the depressed actuating arm is released and returns to its original operating position. When all of the flexible bag material is contained and the actuating arm is released, the closing cycle is allowed to continue and the bag closure and bag are then released, the closure having been secured to the bag without frictional damage and accommodating the entirety of the bag neck width.

DETAILED DESCRIPTION OF THE INVENTION

Figure 1:
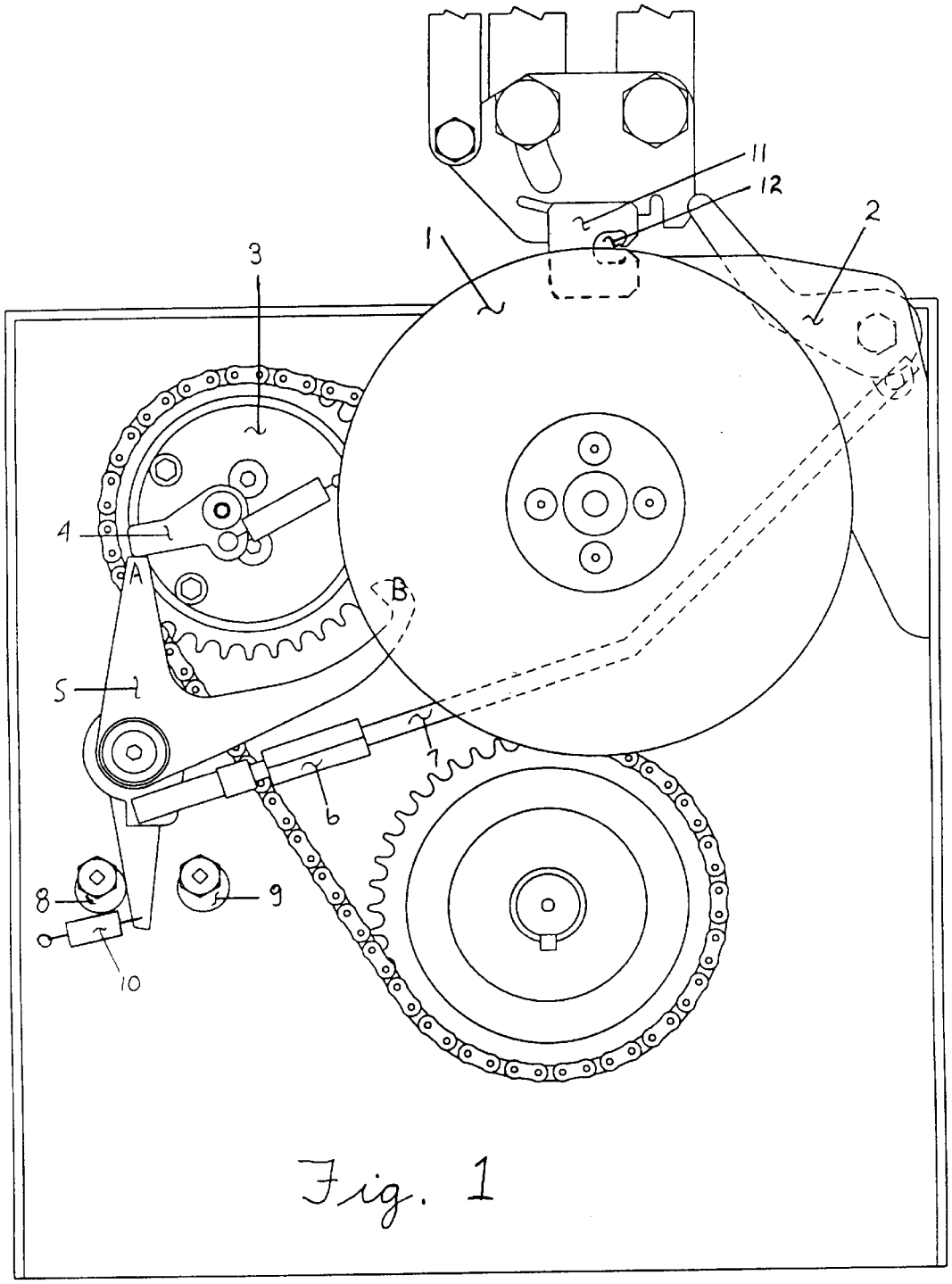
FIG. 1 shows the operating parts and system for an improved clutch control capable of automatically sensing bag length, the operating parts being in a first position at the start of a closing cycle.

In FIG. 1, the bag approaches the closing roll (1) which is mechanically driven by a motor through a chain and sprocket, as disclosed in patent '967. There is also a bogie belt drive system (not shown) which presses down upon the closing roll and produces the tractive force to drive the bag into the closure (11).

In the closing operation, a bag neck having a particular width moves towards the bag closing machine's bag closing head along the bogie belt drive system. As a bag passes toward the closure aperture (12) the bag depresses the clutch actuating arm (2), causing the arm to rotate, counter-clockwise in this embodiment. The rotation is transmitted via the clutch operating rod (7) which is mechanically connected to the clutch actuating arm (2) on one end and the clutch operating arm (5) on the other. An extension limiter (6) allows for telescopic extension of the operating rod (7) so that the clutch actuating arm (2) can rotate flush to the surface of the closing roll (1). Eccentric stops (8) and (9) prevent over rotation of the clutch operating arm (5). Upon rotation of the clutch operating arm (5), a clutch lever (4) is released from contact with first stop surface (A) and the clutch (3) begins a cycle of rotation.

Figure 2:
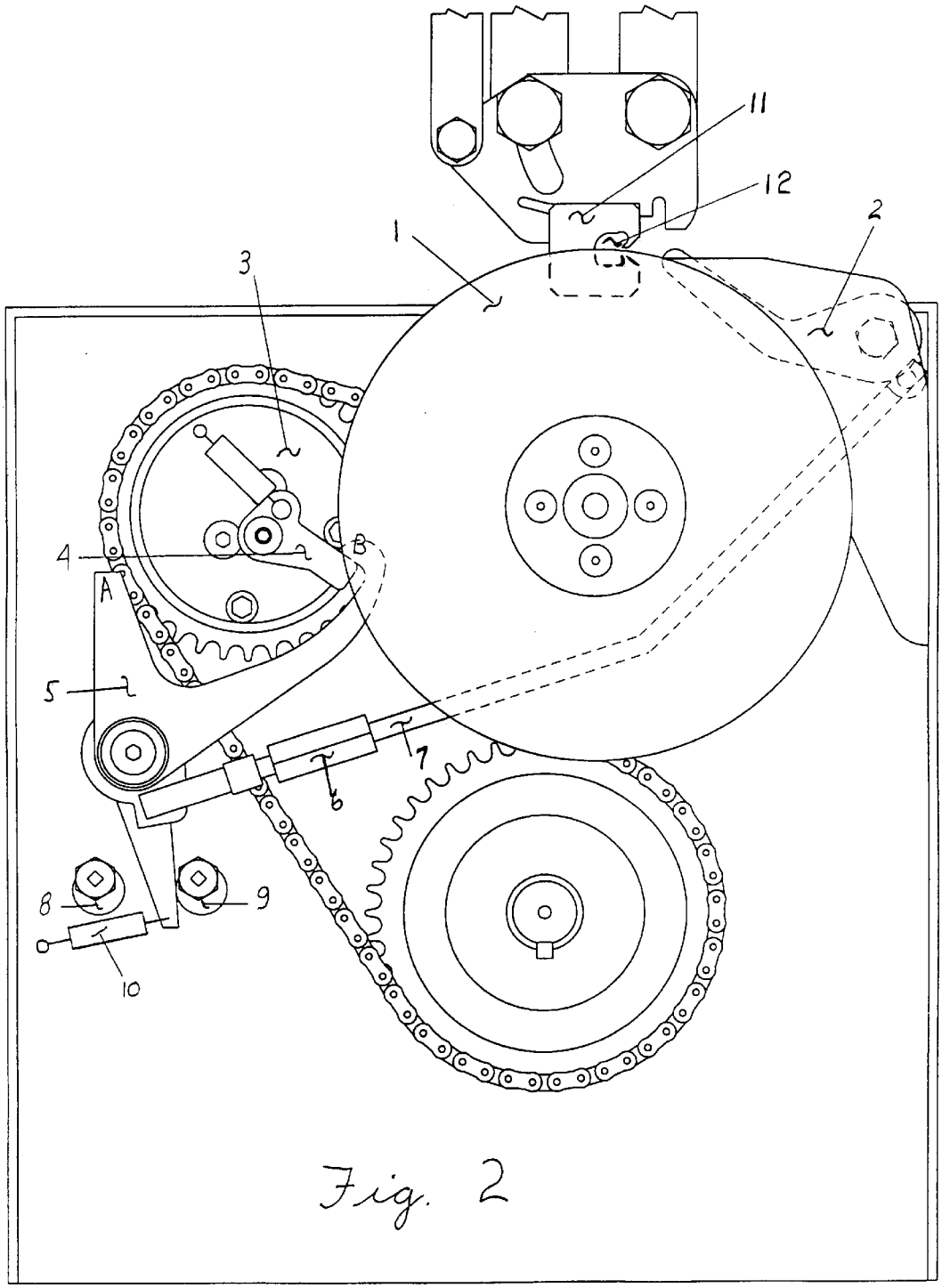
FIG. 2 shows the operating parts and system for an improved clutch control capable of automatically sensing bag length, the operating parts being in a second position during the interruption of a closing cycle.

The clutch actuating arm (2) remains depressed, maintaining the clutch operating arm (5) in a rotated state as seen in FIG. 2. With the clutch operating arm (5) in this rotated state, the second stop surface (B) interrupts the rotation of the clutch (3) by engaging the clutch lever (4), thus stopping the closing cycle. This position is maintained until the entirety of the bag neck has passed beyond the clutch actuating arm (2) and into the closure (11). Once the trailing edge of the bag neck has moved out of contact with the clutch actuating arm (2), spring (10) rotates the clutch operating arm (5) which in turn rotates stop surface (B) which releases clutch lever (4) and allows the clutch (3) to re-engage. Re-engagement of the clutch (3) allows for completion of the rotation and the closing cycle and thereby the release of the closure (11). The clutch (3) completes its rotation cycle in the starting position of FIG. 1, when the first stop surface (A) again engages the clutch lever (4) and a new closure subsequently is placed in the closing head, as substantially described in '967.

The disclosure herein of only a single preferred embodiment of the improvement which is the focus of the present invention is for illustrative purposes only and it is to be understood that various changes and modifications may be made to the disclosed device by one of ordinary skill in the arts without departing from the spirit of the invention or the scope of the claim.

I claim:

1. An improved clutch control for a clutch-actuated bag closing head on a bag neck closing apparatus with a bag closing head, including a means for applying a semi-rigid bag closure on a bag neck, rollers for feeding a bag into the means for applying a bag closure, a clutch for completing a closing cycle wherein a closure is applied to a bag neck in said bag closing head, the clutch including an actuating arm rotatably connected to a clutch operating arm, a first stop surface extending from said clutch operating arm, such that upon the bag contacting said clutch actuating arm said operating arm is rotated allowing the clutch to rotate and begin the cycle for the bag closing head, and a clutch lever fixedly attached to said clutch and releasably connected to said operating arm at said first stop surface such that upon rotation of the operating arm, said first stop surface is rotated out of engagement with the clutch lever so that the clutch lever and clutch are released and free to rotate, the improvement comprising:

a second stop surface extending from said operating arm so that when said operating arm rotates, said second stop surface interrupts the rotation of said clutch by engaging said clutch lever to stop the cycle of the bag closing head until said clutch actuating arm is released, whereby bags of varying closure widths can be accommodated during the closing cycle.

2. The improved clutch control of claim 1, further comprising a frame supporting the bag closing apparatus and a spring fixedly attached between the frame and the clutch operating arm for biasing the operating arm so that upon release of the actuating arm from contact with a bag, said second surface is released from contact with said clutch lever, allowing said clutch and clutch lever to freely rotate until said clutch lever contacts said first stop surface of the operating arm.

* * * * *